United States Patent [19]

Nomura et al.

[11] Patent Number: 5,049,245

[45] Date of Patent: Sep. 17, 1991

[54] METHOD FOR PRODUCING RESIN-COATED RUST-PROOF STEEL SHEETS WITH PROPERTIES SUITABLE FOR ELECTRODEPOSITION COATING

[75] Inventors: Shingo Nomura, Akashi; Kenji Miki, Himeji; Kanji Nakamura, Kakogawa, all of Japan

[73] Assignee: Kabushiki Kaisha Kobe Seiko Sho, Kobe, Japan

[21] Appl. No.: 488,897

[22] Filed: Mar. 6, 1990

[30] Foreign Application Priority Data

Mar. 6, 1989 [JP] Japan ..... 1-53484

[51] Int. Cl.[5] ..... C25D 5/48; C23C 28/00

[52] U.S. Cl. ..... 204/27; 204/35.1; 204/38.1; 204/38.7

[58] Field of Search ..... 204/27, 28, 35.1, 38.1, 204/38.7

[56] References Cited

U.S. PATENT DOCUMENTS 2,648,626 8/1953 Buser ..... 204/28
2,911,332 11/1959 Schuster et al. ..... 148/6.2
4,483,907 11/1984 Salm ..... 204/28 X

FOREIGN PATENT DOCUMENTS 2398811 2/1979 France .
2550227 8/1985 France .

OTHER PUBLICATIONS

Metal Finishing Guidebook and Directory for 1975, Metals and Plastics Publications, Inc., Hackensack, N.J., pp. 511-513.

Chemical Abst., vol. 95, Part 4, Jul. 27, 1981, p. 217, Abstract 28640c, Columbus, Ohio, U.S.; & JP-A-80 152 184 (Nippon Paint) 27-11-80.

Patent Abst. of Japan, vol. 8, No. 106 (c-223) [1543], May 18, 1984; & JP-A-59 20 475 (Nitsushin Seikou K.K.) 02-02-1984.

*Primary Examiner*—John F. Niebling
*Assistant Examiner*—William T. Leader
*Attorney, Agent, or Firm*—Oblon, Spivak, McClelland, Maier & Neustadt

[57] ABSTRACT

Described herein is a method for producing a resin-coated rust-proof steel sheet with properties suitable for electrodeposition coating, the method including the step of, prior to chromate treatment and resin coating, immersing a zinc- or zinc alloy- electroplated steel sheet in an acid bath containing at least one member selected from the group consisting of sulfuric acid, chloric acid, phosphoric acid, boric acid and nitric acid and salts thereof and having a pH value smaller than 6, inclusive, to remove a surface layer of the electroplating on said steel sheet, thereby activating the plated surface in such a manner as to improve the quality of the following chromate treatment. Advantageously, the method further includes the step of grinding the electroplated surface with a brush or roll containing fine abrasive grains of #200 or a higher number to remove said surface layer simultaneously with or separately from the immersion in the acid bath.

7 Claims, No Drawings

METHOD FOR PRODUCING RESIN-COATED RUST-PROOF STEEL SHEETS WITH PROPERTIES SUITABLE FOR ELECTRODEPOSITION COATING

BACKGROUND OF THE INVENTION

1. Field of the Invention

This invention relates to a method for producing resin-coated rust-proof steel plates or sheets with properties suitable for electrodeposition coating, the steel plates or sheets being particularly suitable for application to articles which bear an electrodeposition coating like steel sheets for automobile bodies.

2. Description of the Prior Art

To cope with the strong demands for high corrosion resistance, for example, there has been a trend toward using surface-treated corrosion resistant steel sheets for automobile bodies in place of the conventional cold rolled steel sheets. In this regard, besides the galvanized steel sheets, there have been widely put into use a variety of surface-treated steel sheets including steel sheets plated with a zinc alloy in single or multiple layers containing one or more alloy elements such as Ni, Fe, Mn, Mo, Co, Al and the like in addition to zinc, and resin-coated rust-proof steel sheets as obtained by forming chromate and resin layers on such plated steel sheets.

However, in most cases the electrodeposition coatings formed on the conventional resin-coated rust-proof steel sheets are found to have inferior quality in outer appearance.

SUMMARY OF THE INVENTION

Under these circumstances, it is an object of the present invention to solve the above-mentioned problem of the prior art, namely, to provide a method for producing a resin-coated rust-proof steel sheet with properties suitable for electrodeposition coating.

In accordance with the present invention, there is provided a method for producing a resin-coated rust-proof steel sheet suitable for electrodeposition coating, the method comprising the step of immersing a zinc- or zinc alloy-electroplated steel sheet in an acid bath holding an aqueous solution containing at least one member selected from the group consisting of sulfuric acid, chloric acid, phosphoric acid, boric acid and nitric acid and salts thereof and having a pH value smaller than 6, inclusive, to remove a surface layer of the plating on the steel sheet, prior chromate treatment and resin coating stages.

According to another aspect of the invention, there is also provided a method for producing a resin-coated rust-proof steel sheet suitable for electrodeposition coating in a more advantageous manner, the method comprising the step of immersing a zinc- or zinc alloy-electroplated steel sheet in an acid bath containing at least one member selected from the group consisting of sulfuric acid, chloric acid, phosphoric acid, boric acid and nitric acid and salts thereof and having a pH value smaller than 6, inclusive, to remove a surface layer of the electroplating, and the step of grinding the surface layer with a brush or roll containing fine abrasive grains of #200 or a higher number to remove the surface layer simultaneously with or separately from the immersion in the acid bath, prior to chromate treatment and resin coating.

PARTICULAR DESCRIPTION OF THE INVENTION

According to the method of the present invention, a steel sheet electroplated with zinc or a zinc alloy is immersed in a predetermined acid bath to remove a surface layer of the plating, more advantageously, in combination with an operation of grinding the plated surface with a brush or roll containing abrasive grains to add mechanical action to the chemical action in removing the surface layer, thereby activating the plated surface in such a manner as to improve the quality of the chromate treatment and to ensure formation of a satisfactory electrodeposition coating.

The correlation between the activation of the surface of the zinc or zinc alloy plating according to the invention and the reactivity of chromate is not necessarily clear at this stage, but seems to involve the following mechanisms although the invention is not restricted by any theory in this regard.

Generally, a zinc or zinc alloy-electroplated steel sheet is washed with water and dried in the stages subsequent to the electroplating. During the transfer from the plating to the washing stage, the plated surface still bears the electrolyte thereon, which is normally adjusted to a pH in the range of 1 to 4. In that pH range, the plated surface tends to re-dissolve and form hydrate of zinc or of the alloy element. The hydrate is mostly removed from the plated surface in the washing stage, but partly remains on the plates surface. It is considered that the residual hydrate turns into oxide in the drying stage of the steel sheet, and the coating film layer which is formed on the plated surface by the mixture of the hydrate and oxide of zinc or zinc alloy has inferior reactivity as compared with the activated surface, impeding the reaction with the chromate solution which will be applied in the next stage and as a result deteriorating the adhesion of the chromate film to the plated surface.

Accordingly, when a resin is coated on the steel sheet after such a chromate treatment, the resulting chromate layer is caused to detach from the plated surface by the hydrogen gas which is generated in the stage of electrodeposition coating, and consequently the appearance of the electrodeposition coating is considerably impaired by the peeled or loose film portions.

In the method of the present invention, there is no particular restriction on the zinc or zinc alloy-electroplated steel sheet itself and on the method for manufacturing such steel sheet.

According to the method of the invention, a zinc- or zinc alloy-electroplated steel sheet is firstly immersed in an acid bath holding an aqueous solution containing at least one member selected from the group consisting of sulfuric acid, chloric acid, phosphoric acid, boric acid and nitric acid and the salts thereof and having a pH value smaller than 6. Examples of useful salts include sodium sulfate, sodium borate, potassium nitrate, sodium phosphate and the like.

In the present invention, the acid bath containing an inorganic acid or its salt needs to have a pH value smaller than 6, inclusive. If the pH value exceeds 6, it becomes difficult to remove the film layer of the above-mentioned inactive mixture from the plated surface, failing to activate the surface to a sufficient degree and resulting in inferior effect on the improvement of the electrodeposition coating. On the other hand, the lower the pH of the acid bath, the more the dissolution of the plated layer is accelerated to shorten the processing time. In such a case, however, there will arise problems such as overetching and irregularities in the degree of processing. Therefore, in view of the stability in quality and economy of the final products, the pH value of the acid bath is preferred to be larger than 3 and more specifically in the range of 3–5.

According to the invention, resin-coated steel plates or sheets with properties suitable for electrodeposition coating can be obtained more advantageously with higher productivity and in a shorter processing time by grinding the plated surface of a steel sheet with a brush or roll containing #200 or finer abrasive grains, simultaneously with or before or after the step of immersing the electroplated steel sheet in the above-described acid bath, for removal of the surface layer of the plating.

The abrasive grains on the brush or roll to be used for grinding the plated surface layer should be of #200 or finer grain size because the use of coarse abrasive grains larger than #200 is likely to result in overgrinding and a plated surface layer which is too coarse to form an electrodeposition coating with a surface of satisfactory appearance. On the contrary, if the abrasive grains are too fine, the grinding operation takes a longer time, inviting a drop in productivity. Accordingly, the size of the abrasive grains is preferred to be smaller than #500.

The operation of grinding the plated surface layer of the steel sheet with a brush or roll containing abrasive grain may be effected simultaneously with or subsequent to the above-described immersion in the acid bath. If desired, the surface layer of the plating on the steel sheet may be ground prior to the immersion in the acid bath.

As clear from the foregoing description, the method of the present invention makes it possible to obtain a resin coated rust-proof steel sheet which is capable of forming thereon an electrodeposition coating of satisfactory quality, by immersing a zinc- or zinc alloy-electroplated steel sheet in an acid bath prior to a chromate treatment and resin coating, advantageously in combination with a step of grinding the plated surface with a brush or roll containing abrasive grains to remove a surface layer of the plating by chemical and/or mechanical actions to put the plated surface in an activated state which improves the succeeding chromate treatment.

The invention is illustrated more particularly by the following examples, which however should not be restrictive of the invention in any way whatsoever. In the following description, the pH of the acid bath was adjusted by the use of an acid having the same anion as sodium hydroxide or its salt.

EXAMPLE 1

According to ordinary procedures, after degreasing and acid washing, a Zn-Ni alloy was electroplated on 8 mm thick cold rolled steel sheets by the use of an acid bath at a deposition rate of 20 g/m$^2$.

Thereafter, each steel sheet was immersed in one of the acid baths having the compositions as shown in Table 1 for 5 seconds at room temperature, and, after water washing and drying, subjected to a chromate treatment (i.e., application of 40 wt % aqueous solution of reduced chromate and drying for 1 minute at 150° C. to have total chromium application rate of 40–50 g/m$^2$). Then, a water-soluble resin was applied with a bar coater in a thickness of about 1 μm, and baked at a temperature of 180° C. for 1 minute to obtain a resin-coated rust-proof steel sheet.

The thus obtained resin-coated rust-proof steel sheets were coated with a cationic electrodeposition paint with electrodeposition voltage of 200 V, building-up control of 30 seconds and coating time of 2.5 minutes, followed by baking at 170° C. for 20 minutes to obtain a steel sheet with an electrodeposition coating. Existence of pimple-like defects on the surface of the electrodeposition coating of each steel sheet was checked to assess the quality of the electrodeposition coating. The results are shown in Table 1.

TABLE 1

| Ex. | Specimens | Bath Contents | pH | Resin | Pimples |
|---|---|---|---|---|---|
| Ex. 1 | No. 1 | Sulfuric acid | 2.0 | Acrylic | Nil |
| | No. 2 | Chloric acid | 2.5 | Epoxy | Nil |
| | No. 3 | Phosphoric acid | 3.0 | Urethane | Nil |
| | No. 4 | Boric acid + sodium borate | 4.0 | Acrylic | Nil |
| | No. 5 | Sodium sulfate | 5.0 | Epoxy | Nil |
| | No. 6 | Sodium phosphate | 5.5 | Urethane | Nil |
| | No. 7 | Nitric acid + potassium nitrate | 6.0 | Epoxy | Nil |
| Compr. Ex. | No. 8 | Sodium borate | 7.0 | Acrylic | Yes |

EXAMPLE 2

Zn-Ni was electroplated on the same cold rolled steel sheets as in Example 1, which were then immersed in one of the acid baths of the compositions shown in Table 2 for 3 seconds at room temperature while simultaneously grinding the plated surface for 3 seconds with a brush or roll containing abrasive grains as indicated in Table 2.

Thereafter, each steel sheet was subjected to a chromate treatment and resin coating in the same manner as in Example 1 to obtain a resin-coated rust-proof steel sheet. After coating the steel sheet by electrodeposition under the same conditions as in Example 1, the quality of the electrodeposition coating was assessed. The results are shown in Table 2.

TABLE 2

| Ex. | Specimen | Bath Contents | pH | Brush/Roll | Grain # | Resin | Pimples |
|---|---|---|---|---|---|---|---|
| Ex. 2 | No. 9 | Sulfuric acid | 2.5 | Brush | 200 | Epoxy | Nil |
| | No. 10 | Phosphoric acid | 3.5 | Brush | 500 | Acrylic | Nil |
| | No. 11 | Sodium sulfate | 4.0 | Roll | 300 | Urethane | Nil |
| | No. 12 | Sodium borate | 3.5 | Brush | 600 | Acrylic | Nil |
| Compr. Ex. | No. 13 | Sodium phosphate | 4.5 | Roll | 150 | Acrylic | Grinding lines |
| | No. 14 | — | — | — | — | — | Yes |

EXAMPLE 3

Zn-Ni alloy was electroplated on the same cold rolled steel sheets as in Example 1, and, after grinding the plated surface with a brush or roll containing the abrasive grains of Table 3 for 2 seconds, each plated steel sheet was immersed in one of the acid baths having the compositions indicated in Table 3 for 3 seconds at room temperature.

Thereafter, chromate treatment and resin coating were carried out in the same manner as in Example 1 to obtain resin-coated rust-proof steel sheets. Then, electrodeposition coating was formed on each of these steel sheets under the same conditions as in Example 1, and the quality of the electrodeposition coating was assessed. The results are shown in Table 3.

TABLE 3

| | Specimen | Brush/Roll | Grain # | Bath Contents | pH | Resin | Pimples |
|---|---|---|---|---|---|---|---|
| Ex. 1 | No. 15 | Roll | 250 | Phosphoric acid + sodium phosphate | 4.0 | Urethane | Nil |
| | No. 16 | Brush | 400 | Chloric acid | 2.0 | Acrylic | Nil |
| Compr. | No. 17 | Brush | 400 | Sodium borate | 7.0 | Epoxy | Yes |
| Ex. | No. 18 | Roll | 50 | Nitric acid | 2.0 | Urethane | Grinding lines |

EXAMPLE 4

Zn-Ni alloy was electroplated on the same cold rolled steel sheets as in Example 1, and the plated steel sheets were immersed in one of the acid baths of the composition shown in Table 4 for 2 seconds at room temperature, thereafter grinding the plated surface of each steel sheet with a brush or roll containing abrasive grains as shown in Table 4 for 2 seconds.

Then, chromate treatment and resin coating were carried out in the same manner as in Example 1 to obtain resin-coated rust-proof steel sheets, followed by electrodeposition coating under the same conditions as in Example 1 and assessment of the resulting electrodeposition coating. The results are shown in Table 4.

As clear from the foregoing description, the method of the present invention makes it possible to obtain resin-coated rust-proof steel sheets or plates with properties particularly suitable for electrodeposition coating.

TABLE 4

| | Specimen | Bath Contents | pH | Brush/Roll | Grain # | Resin | Pimples |
|---|---|---|---|---|---|---|---|
| Ex. 4 | No. 19 | Sulfuric acid | 2.5 | Brush | 300 | Acrylic | Nil |
| | No. 20 | Sodium phosphate | 4.0 | Roll | 600 | Epoxy | Nil |
| Compr. Ex. | No. 21 | Sodium nitrate | 3.5 | Roll | 100 | Urethane | Grinding lines |
| | No. 22 | Sodium sulfate | 7.5 | Brush | 300 | Acrylic | Yes |

What is claimed is:

1. A method for producing a resin-coated rust-proof steel sheet having properties suitable for electrodeposition coating, which comprises:

a) immersing a zinc- or zinc alloy-electroplated steel sheet in an acid bath containing at least one member selected from the group consisting of sulfuric acid, chloric acid, phosphoric acid, boric acid and nitric acid and salts thereof and having a pH value of less than 6, inclusive, to remove a surface layer of the electroplating; and grinding the electroplated surface with a brush or roll carrying fine abrasive grains of #200 or a higher number to remove a surface layer concurrently, before or after the immersion in said acid bath;

b) subjecting said steel sheet to chromate treatment; and c) resin-coating said chromate-treated steel.

2. The method of claim 1, wherein said salts are selected from the group consisting of sodium sulfate, sodium borate, potassium nitrate and sodium phosphate.

3. The method of claim 1, wherein said acid bath has a pH of from 3 to 5.

4. The method of claim 1, wherein said abrasive grains are smaller than #500.

5. The method of claim 1, wherein said acid bath is at room temperature.

6. The method of claim 1, which further comprises washing the electroplated steel after immersion in the acid bath of step a) and drying the same prior to subjecting the steel to the chromate treatment of step b).

7. The method of claim 1, wherein said resin for resin-coating the chromate-treated steel is selected from the group consisting of acrylic, epoxy and urethane resins.

* * * * *